United States Patent [19]

Morszeck

[11] Patent Number: 4,509,622

[45] Date of Patent: Apr. 9, 1985

[54] SUITCASE

[76] Inventor: Dieter Morszeck, Kinkelstr.16, 5000 Koeln 41, Fed. Rep. of Germany

[21] Appl. No.: 513,982

[22] Filed: Jul. 14, 1983

[30] Foreign Application Priority Data

Nov. 15, 1982 [DE] Fed. Rep. of Germany ..... 3242265

[51] Int. Cl.[3] ..... A45C 5/04

[52] U.S. Cl. ..... 190/119; 190/124

[58] Field of Search ..... 70/69, 73; 190/119, 190/120, 100, 124, 126

[56] References Cited

U.S. PATENT DOCUMENTS

| | | | |
|---|---|---|---|
| 828,423 | 8/1906 | Ransom | 70/73 |
| 3,135,105 | 6/1964 | Brody | 190/120 |
| 3,576,238 | 4/1971 | Chubb | 190/120 |
| 3,584,906 | 6/1971 | Budzyn | 70/73 |
| 3,605,961 | 9/1971 | Marrion | 190/120 |
| 3,698,753 | 10/1972 | Atkinson | 70/73 |
| 3,828,899 | 8/1974 | Scott | 190/120 |
| 4,094,392 | 6/1978 | Gregg et al. | 190/120 |

*Primary Examiner*—Stephen Marcus
*Assistant Examiner*—David Voorhees
*Attorney, Agent, or Firm*—Michael J. Striker

[57] ABSTRACT

A suitcase with a two-part lock has two shells hingedly connected to each other for movement thereof between an open and a closed position. Each shell has a top surface provided with an indentation for accommodating one portion of the lock. Through such a provision, upon moving the shells into the closed position, no parts of the lock project beyond the top surface.

7 Claims, 7 Drawing Figures

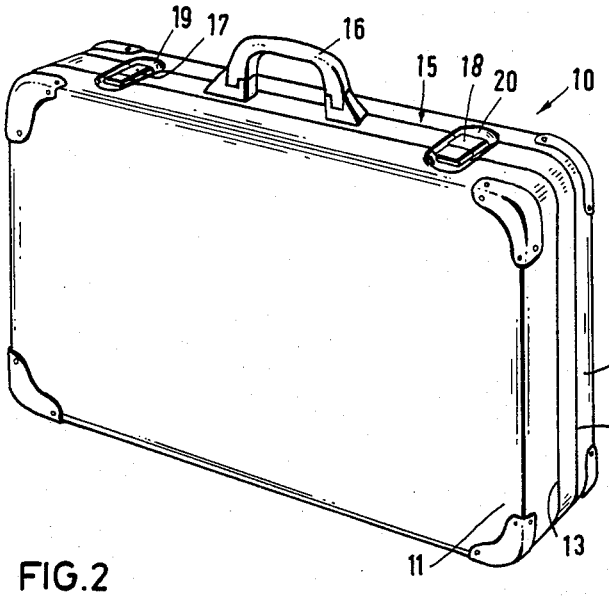
FIG.1
FIG.2
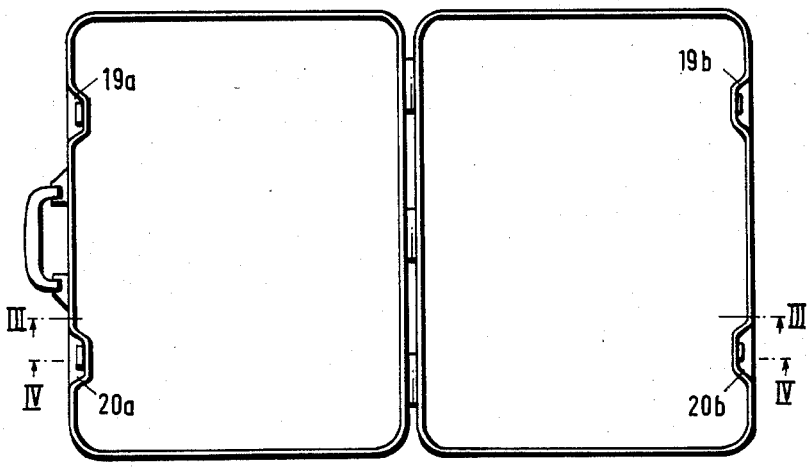
FIG.3
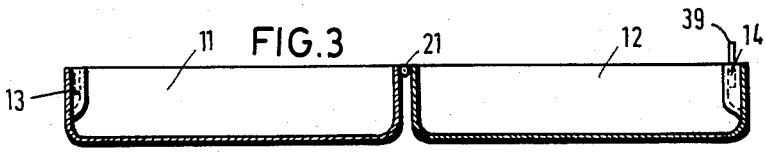

SUITCASE

BACKGROUND OF THE INVENTION

The invention relates to a suitcase, and in particular to a suitcase provided with a two-part lock, preferably a lever lock.

In prior-art suitcases of this kind, the locks are generally arranged in such a manner that they project beyond the respective surface of the suitcase. Through such a provision, the locks can be damaged, for example when arranging fully packed suitcases above each other during a transport so that the bottom of the uppermost suitcase may damage the projecting locks of the underlying suitcase.

It is also conceivable that upon stacking up of the suitcases in the mentioned manner, the not completely closed lock may be released through the mechanical impact of the superposed suitcases. Consequently, packed articles may fall out and may get lost.

It has been proposed to arrange the locks of a suitcase in a recess wherein only one of the suitcase shells is provided on the one side on which both locks are arranged at each side of the holding grip, with a recess extending over the entire length. In this recess, both locks are arranged and each cooperate with a lock hook located at the other suitcase shell which hook is arranged at the inner side of the suitcase shell.

Suitcases with such a design have the disadvantage that the employed lock hooks are rather weak and are unsuitable when using larger suitcases because of the high forces required for closing the suitcase. Moreover, it is to be noted that locks cooperating with such lock hooks permit only a relatively small stroke motion and the lock hooks can be rendered ineffective by articles located between lock and lock hook during closing of the suitcase.

In general, it is to be noted that locks having a lever pull lock are especially suitable for large suitcases because the lever not only allows a large stroke but also high locking forces.

Known suitcases provided with such lever locks which are arranged at the outside have, however, the aforementioned disadvantage which resides in the fact that they can be easily released and be damaged.

SUMMARY OF THE INVENTION

It is therefore an object of the present invention to avoid the disadvantages of the prior art.

In particular, it is an object of the present invention to provide a suitcase in such a manner that the locks can not be unintentionally released and is protected against any damage.

Yet another feature of the present invention is to provide a suitcase in which the locks are also protected against contamination.

A concomitant object of the present invention is to provide a suitcase having a lock which is simple in construction, reliable in operation and inexpensive to manufacture.

In keeping with these objects and with others which will become apparent hereinafter, one feature of the invention resides in a suitcase comprising two shells hingedly connected to each other so as to be movable between an open position and a closed position, wherein each of the shells has a top surface provided with at least one indentation cooperating with each other so as to define a common indentation of predetermined contour when moving the shells into the closed position; and means for locking the shells when the shells being moved from the open position into the closed position, the locking means including two locking members cooperable with each other, wherein one of the two members is associated with one of the shells and the other of the two members is associated with the other of the shells, the first and the second indentations having such a depth that upon locking the shells when being moved from the open position into the closed position, the locking means being completely disposed within the common indentation without projecting beyond the top surface.

Through the provision of such a common indentation in which the two cooperating locking members of the lock are disposed, it is achieved that the lock is protected from damage when being in locking position because no part of the lock extends beyond the outer surface of the suitcase.

A further advantage of this arrangement is the fact that objects are prevented from contacting with the lock so that an unintentional release thereof is avoided.

According to a further feature of the invention, the common indentation is oval-shaped.

According to still another feature of the present invention, each of the shells is provided along its circumferential edge with a profile strip, each of which has a contour corresponding to the contour of the common indentation so as to form a loop-shaped bending.

The indentations according to the invention which are provided only in the area of the locks in both suitcase shells can be provided in suitcases of different materials, such as for example suitcases of vulcanized fiber. In such suitcases, it is possible to produce the shells in a pre-step without the indentations according to the invention and then subject the shells to heat and pressure in order to mold the respective indentations. In this case, it is also possible to mold simultaneously in addition to the molding of the indentations the profile ridges arranged at the circumferential edge of each shell in order to adapt their contour to the contour of the indentations. In general, the profile ridges are made of aluminum.

Suitcases made of thin aluminum sheet can, however, only be molded in a very difficult manner since they do not have the necessary hardness of sheets to be used. In order to avoid these difficulties, according to another feature of the invention, the first and the second shell is provided with a respective first and second recess, and further comprising a first shaped body insertable into the first recess to form the first indentation and with a second shaped body insertable into the second recess to form the second indentation.

Through the provision of such shaped bodies, which can be easily produced, even suitcases of thin aluminum sheet can be provided with indentations according to the invention.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 illustrates a suitcase in perspective view;

FIG. 2 is a top view of the suitcase in an open position;

FIG. 3 is a view of the suitcase along line III—III according to FIG. 2;

DESCRIPTION OF THE PREFERRED EMBODIMENTS

Figure 4:
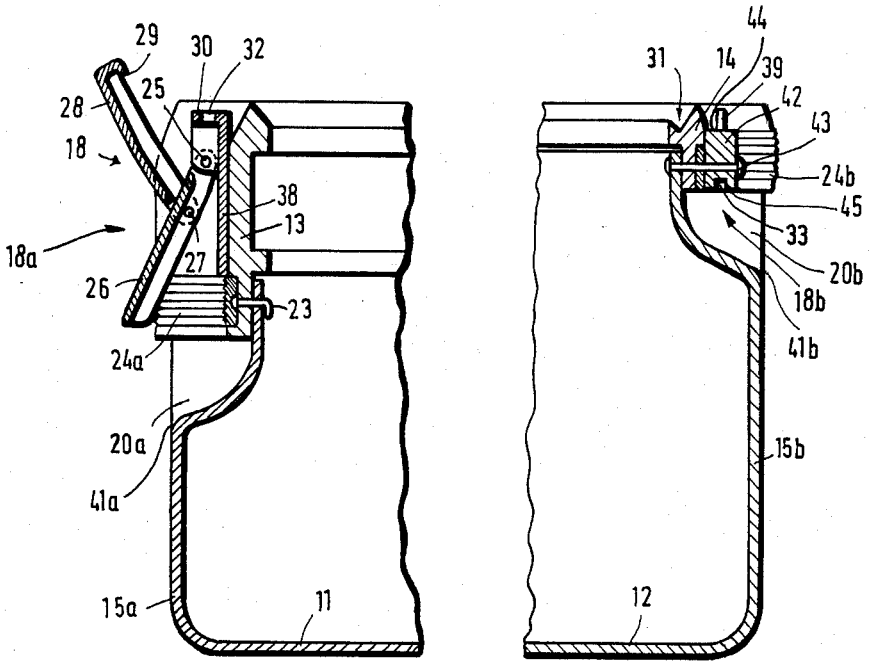
FIG. 4 shows an enlarged illustration of the suitcase along the line IV—IV according to FIG. 2, wherein the relevant parts are broken away.

Referring firstly to FIG. 1, there is shown a suitcase 10 composed of two shells 11, 12 which provide a space for articles to be packed. At the circumferential edge, each shell 11, 12 is provided with a respective profile edge 13, 14. The shells 11, 12 are connected to each other by a hinge 21 so as to be movable between an open and a closed position. When the two shells are moved to the closed position, a top surface 15 is obtained which is defined by the shells 11, 12 and the associated profile strips 13, 14. On the top surface 15 a carrying grip 16 is arranged for facilitating the carrying and lifting of the suitcase. Spaced from each other on the top surface 15 and positioned at each side of the carrying grip 16, indentations 19, 20 are provided which accommodate respective locking means 17, 18.

The indentations which are generally characterized in FIG. 1 by reference numerals 19, 20 are each designed in each shell 11, 12 by respective indentations **19*a*, 19*b*; 20*a*, 20*b*** (FIG. 2).

The indentations 19, 20 are obtained by molding the suitcase shells 11, 12 in a commonly known manner. The profile ridges 13, 14 which are arranged at the circumferential edge of the respective shell extend within the indentation 19, 20 correspondingly to the contour thereof and consequently have a respective loop-shaped bending. The profile strip 13 is connected with the circumferential edge of the shell 11 by rivet 23 or the like, while the profile strip 14 is connected to the circumferential edge of the shell 12 by rivet 43 or the like. The heads of the rivets 23, 43 are covered by a plastic tape or foil **24*a*, 24*b***.

As can be seen from FIG. 4, the locking means are composed of two locking members **18*a*, 18*b* arranged in the indentation 20*a*, 20*b* or 19*a*, 19*b* (not shown). The locking member 18*a* as located in the indentation 20*a* includes a base plate 38 which includes a first straight portion riveted to the profile ridge 13. Angularly projecting from the straight portion, a guide portion 30 is arranged to give the base plate an L-shaped form. The guide portion 30 is provided with a through hole 32** the purpose of which will be described hereinbelow.

Connected to the base plate 38 via a joint 25 is one end of a grip 26 to which a lever 28 is jointly connected via a joint 27 located at an intermediate portion of the grip 26. The lever 28 is provided at one end thereof with a catch 29.

The locking member **18*b* of the lock 18 which is accommodated in the indentation 20*b* includes a clamping member 42 which has a surface 44 provided with a pin 39 projecting therefrom and with a surface 45 provided with a groove 33. The clamping member 42 as well as the profile strip 14 is fixed to the wall 15*b* of the shell 12 via the rivet 43. The profile ridge 14 is also provided with a circumferential groove 31 which engages a respective portion of the profile strip 13 when moving the shells 11, 12** into the closed position.

Figure 6:
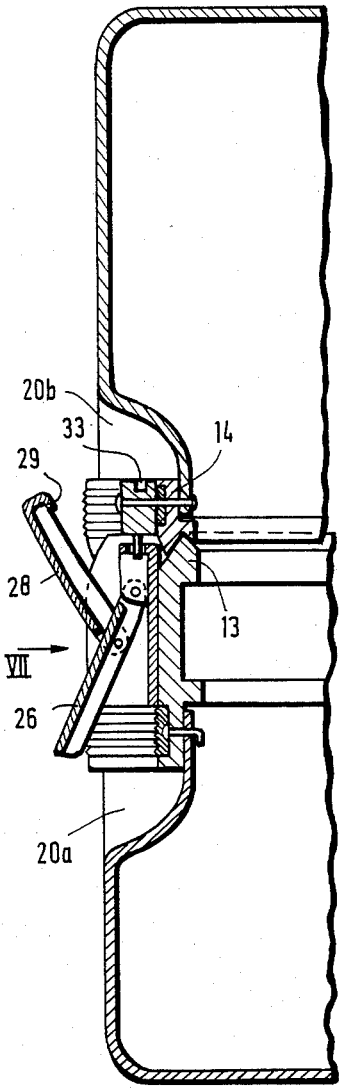
FIG. 6 shows the suitcase in a closed but not yet locked position.

When moving the shells 11, 12 from the open position as shown in FIG. 2 and FIG. 3 into the closed position as shown in FIG. 6, the projecting pin 39 protrudes through the through hole 32 while the groove 31 of the profile strip 14 engages the profile strip 13. Consequently, a prelocking of the suitcase shells is obtained, as can be seen from FIG. 6 which also discloses that both locking members are arranged within the common indentation. Only the grip 26 as well as the lever 28 projects therefrom; however, when tightly locking the suitcase 10, also these parts are arranged within the indentation and do not project beyond the top surface of the suitcase 10, as can be seen from FIG. 1. When the suitcase is completely locked, the catch 29 engages the groove 33. Through the provision of such a lever lock, a high locking force is obtained as is a large lifting motion.

In order to avoid any sharp edges when providing the indentations in the walls **15*a*, 15*b* of the shells 11, 12, the position from the top surface 15 to the respective indentation 19, 20 is developed as a rounded edge 41*a*, 41*b***.

Figure 7:
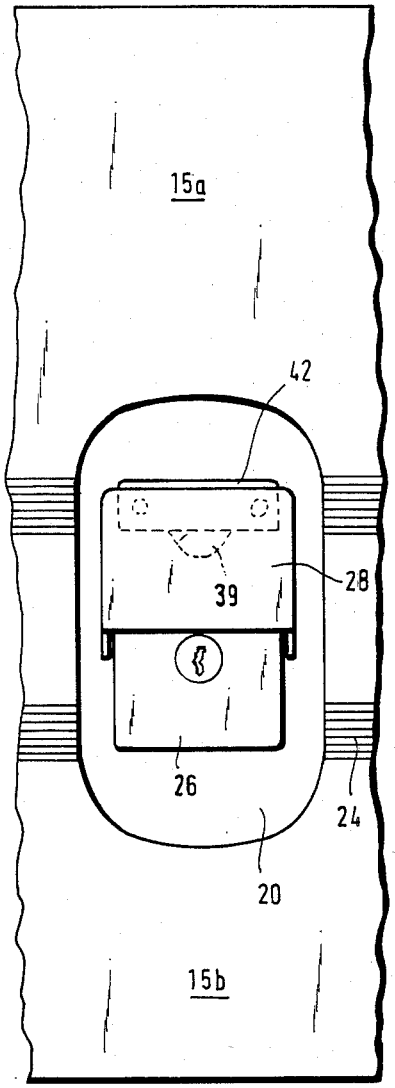
FIG. 7 is a view of the suitcase along arrow VII according to FIG. 6.

As can be especially seen from FIG. 7, each indentation 19, 20 is oval-shaped.

Figure 5:
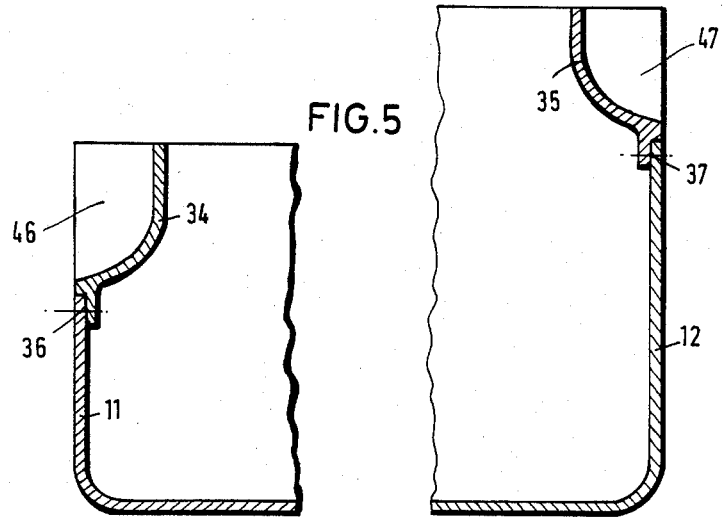
FIG. 5 illustrates the formation of indentations by inserted casts.

Turning now to FIG. 5, it may be seen that the shells 11, 12 are provided with respective cut-outs 46, 47, for example through punching out, in which respective shaped bodies 34,35 are inserted and fixed for example through gluing or by small rivets or nails 36, 37. These shaped bodies 34,35 can be of plastic injection molding. However, it is also possible to use moldable sheets as for example aluminum sheets. When using aluminum sheets, the shaped bodies can have a larger wall thickness than the shells and are composed of a material which is easily deformable. However, also other die cast metals of light metal alloys can be used.

It will be understood that each of the elements described above, or two or more together, may also find a useful application in other types of suitcases differing from the types described above.

While the invention has been illustrated and described as embodied in a suitcase, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A suitcase, comprising a first shell having a top surface provided with a first indentation; a second shell having a further top surface provided with a second indentation, the second shell being hingedly connected to the first shell so that the first and the second shells are movable between an open and a closed position wherein the first and the second indentations define a common indentation of predetermined contour when the first and second shells are moved into the closed position; and means for locking the first and the second shells when the latter are in the closed position, the locking means including two locking members cooperating with each other, wherein one of the two members is connected to one of the shells and the other of the two members is connected to the other of the shells, the first and the second indentations having such a depth that upon locking the first and second shells in the closed position, the locking means is completely enclosed within the common indentation without projecting beyond the top surface and the further top surface of the first and second shells, the first and the second shell each having a circumferential edge and being each provided along its circumferential edge with a profile strip which extends within a respective indentation and has therein a contour corresponding to the contour of the respective indentation so as to form a loop-shaped bending, said common indentation extending across both shells and the profile strip.

2. A suitcase as defined in claim 1, wherein the common indentation is oval-shaped.

3. A suitcase as defined in claim 1, wherein the first and the second shells each are provided with a cut-out, and further comprising a first shaped body insertable into the cut-out of the first shell to form the first indentation, and a second shaped body insertable into the cut-out of the second shell to form the second indentation.

4. A suitcase as defined in claim 3, wherein the first and the second shaped bodies are of plastic injection molding.

5. A suitcase as defined in claim 3, wherein the first and the second shaped bodies are molded sheets.

6. A suitcase as defined in claim 3, wherein the first and the second shaped bodies are of aluminum sheet.

7. A suitcase as defined in claim 1, wherein one of the locking members includes a base plate having a first straight portion fixed parallel to one of the two profile strips and a guide portion angularly projecting from the first portion to form the base plate of L-shape, wherein the guide portion is provided with a through hole, a grip jointly connected to the base plate, a lever jointly connected to the grip and having one end provided with a catch, and wherein the other of the locking members includes a clamping member fixed to the other of the two profile strips and having one surface provided with a projecting pin which is engageable into the through hole and another surface opposite to the one surface provided with a groove so that upon moving the first and second shell into the closed position, the projecting pin engages the through hole for providing a pre-locking and upon manual actuation, the catch of the lever engages into the groove of the clamping member to provide a tight locking of the suitcase.

* * * * *